US005820047A

United States Patent [19]

Paepke et al.

[11] Patent Number: 5,820,047

[45] Date of Patent: Oct. 13, 1998

[54] YARN DELIVERY DEVICE FOR TEXTILE MACHINES

[76] Inventors: Horst Paepke, Hessentorstrasse 83; Joachim Paepke, Graf-Wolfegg-Strasse 32, both of 72108 Rottenburg, Germany

[21] Appl. No.: 730,246

[22] Filed: Oct. 15, 1996

[30] Foreign Application Priority Data

Oct. 13, 1995 [DE] Germany ..... 195 38 135.1

[51] Int. Cl.[6] ..... B65H 51/00

[52] U.S. Cl. ..... 242/47.01; 226/118.1; 226/118.2; 242/364

[58] Field of Search ..... 242/47.01, 364; 226/118.1, 118.2

[56] References Cited

U.S. PATENT DOCUMENTS

| | | | |
|---|---|---|---|
| 3,225,446 | 12/1965 | Sarfati et al. | 242/47.01 |
| 3,761,031 | 9/1973 | Pfarrwaller | 242/47.01 |
| 3,820,731 | 6/1974 | Rosen | 242/47.01 |
| 3,858,830 | 1/1975 | Deniega | 242/47.01 |
| 4,165,049 | 8/1979 | Pejchal et al. | 242/47.01 |
| 4,271,687 | 6/1981 | Memminger et al. | 242/47.01 |
| 4,574,597 | 3/1986 | Buck et al. | 242/47.01 |
| 4,662,575 | 5/1987 | Fecker | 242/47.01 |
| 4,890,464 | 1/1990 | Tsuchiya et al. | 242/47.01 |
| 4,890,800 | 1/1990 | Lenk et al. | 242/47.01 |

FOREIGN PATENT DOCUMENTS 35 01 944 7/1986 Germany .

OTHER PUBLICATIONS

The Above Patent is Discussed in The Above Identified U.S. Patent Application.

*Primary Examiner*—William Stryjewski

[57] ABSTRACT

A yarn delivery device with a yarn storage drum that is mounted to be driven rotatably about an approximately vertical axis. The yarn storage drum has an upper portion with a frustroconical yarn take-up region that is adjoined by an essentially cylindrical yarn storage region with a bead-free lower edge. A yarn is guided tangentially onto the yarn take-up region of the yarn storage drum by a yarn feed guide element, and is taken off from the yarn storage region tangentially by a yarn take-off guide element. The yarn take-off guide element is arranged with respect to the yarn storage region such that the yarn is taken off at least at a spacing from the lower edge of the yarn storage region that corresponds to the distance of the yarn along the vertical axis of the yarn storage drum between an entry and an exit of the yarn on the cylindrical yarn storage region.

22 Claims, 1 Drawing Sheet

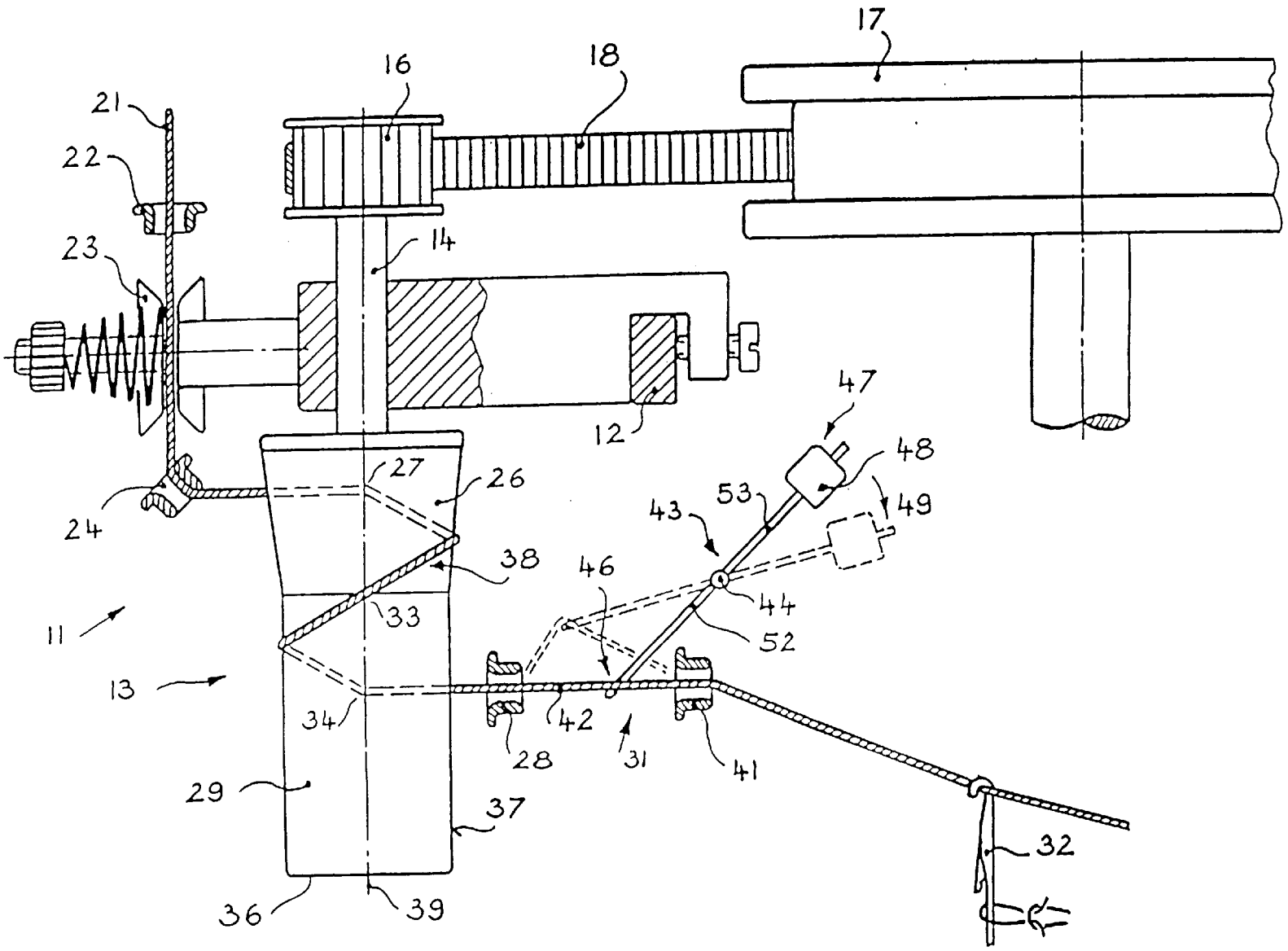
17
18
16
14
12
21
22
23
24
11
13
29
36
39
37
27
26
38
33
34
28
42
31
46
41
32
43
53
44
52
47
48
49

YARN DELIVERY DEVICE FOR TEXTILE MACHINES

BACKGROUND OF THE INVENTION

1. Field of the Invention

The invention relates to a yarn delivery machine for textile machines and more particularly, to a yarn delivery machine having a yarn storage drum with a yarn take-up region and a yarn storage region.

2. Description of Related Art

Yarn delivery devices with the abovementioned features of a yarn storage drum are known, for example, from DE-PS 35 01 944 [Patentschrift=German Granted Patent]. In the case of this yarn storage drum, the yarn to be processed is taken up tangentially, in multiple wraps, by a yarn takeup region of frustroconical shape, and is then transferred to a yarn storage region which is adjacent to, and of lower conicity than, the yarn takeup region. By means of this shape and the multiple turns, the result is attained that the yarn can, on the one hand, be supplied to the yarn processing location of the textile machine at the peripheral speed of the yarn storage drum, without slip, and on the other hand that the yarn is laid down parallel and adjacent, without overwinding and, because of the conicity of the yarn storage region, makes possible a longitudinal displacement of several yarn turns downwards in the axial direction.

The danger exists in such yarn storage drums that if the yarn tension falls, the turns of yarn accumulated on the drum jacket can become free and fall downwards over a bead-free lower edge of the yarn storage region. This can likewise happen when the textile machine is stopped because of a fault, since the yarn can fall down over the bead-free lower edge of the yarn storage region.

On textile machines, yarns are processed which can have very varied properties, due to the different materials such as cotton, wool or synthetic fiber materials from which they are produced, or due to different preparation and finishing, for example, smooth yarns, twisted yarns, crimped yarns or threads, or else different patterns; these different properties can become apparent on the yarn delivery device. For example, for a patterned knitted fabric, on individual needles, either a normal stitch is formed and thus the greatest amount of yarn consumption is required, or the needles are positioned only at the tuck stitch height, so that the old yarn present on the needle remains lying on the opened needle, and the new yarn is caught by the needle hook and is united with the old stitch as a loop in the needle hook when pulled down. The yarn consumption required for this is only about 60%, measured on a stitch which has a yarn consumption of 100%. Moreover, the possibility of patterning a knitted fabric can be provided, in which the supplied yarn is present as floats between two optionally positioned stitches, so that these can be connected by yarn crossings. The yarn consumption for this amounts to only about 20%, measured on a stitch which has a yarn consumption of 100%. The yarn consumption is thus subject to a constant change of amount, during which, at the same time, the maintenance of a low yarn tension is required.

In order for a low and uniform yarn tension to be present during the processing of stitches, loops or floats, and for falling of the yarn off the yarn storage drum to be prevented, a yarn delivery device is known, for example, which consists of a horizontally arranged, cylindrical roll, which is kept at a high rotational speed by an electric motor. The yarn, supplied tangentially, wraps around the cylindrical roll with one turn, and is guided away again tangentially. Irregular yarn consumption gives rise to an irregular yarn tension between this roll and the processing position. Thus different relationships in the friction of the yarn with the peripheral speed of the driven roll are brought about in the same proportion. Thus the case can arise that with a slackening of the yarn tension, the yarn is wound up on the driven roll, and a yarn break occurs on subsequent increase of the yarn tension.

The same process can occur when the knitting machine is switched off or braked. The machine then quickly comes to a standstill, in contrast to which the motor which drives the cylindrical roll is only switched off and not braked, and runs on. In this time interval between the knitting machine becoming stationary and the cylindrical roll running down and becoming stationary, the yarn can be wound up and broken.

Furthermore, a yarn supply device is known in the prior art which consists of a vertical spindle and has a conicity of about 5°. Such a yarn storage drum is driven by a drive belt which is connected to the main drive wheel. In order to prevent the yarn which wraps around the yarn storage drum from falling down when different yarn tensions occur, a yarn guide element with several S-shaped bends is provided, parallel to and spaced from the yarn storage drum. After each turn around the yarn storage drum, the yarn is guided over the yarn guide element, so as to prevent the yarn falling off when the yarn tension changes.

However, this arrangement has the disadvantage that an undesired friction is produced in the S-shaped depressions of the yarn guide element, resulting in increased fiber fly. Furthermore, starting up such a yarn delivery device is very time-consuming, since each wrap has to be placed individually in the S-shaped depression of the guide element. Furthermore, it is disadvantageous that the peripheral speed of the spindle is greater than the speed of the yarn. With increasing yarn tension, the friction of the yarn on the spindle periphery increases, and leads to excessive delivery. When the yarn tension falls, the yarn hangs down, entailing a risk that due to its slackening it can be wound up and broken. This breakdown can occur at each wrap.

SUMMARY OF THE INVENTION

The present invention therefore has as its object to develop a yarn delivery device such that, with for all yarns to be processed which reach the yarn storage drum, in particular with varying consumption of the amount of yarn in patterned knitted fabrics, an orderly discharge of the yarn turns is ensured, without their falling off the storage drum.

This object is attained, according to the invention, by the a yarn delivery device with a yarn storage drum that is mounted and can be driven rotatably about an approximately vertical axis. The yarn storage drum has an upper portion with a frustroconical yarn take-up region that is adjoined by an essentially cylindrical yarn storage region with a bead-free lower edge. A yarn is guide tangentially onto the yarn take-up region or the yarn storage drum by a yarn feed guide element, and is taken-off from the yarn storage region tangentially by a yarn take-off guide element. the yarn take-off guide element is arranged with respect to the yarn storage region such that the yarn is taken off at least at a spacing from the lower edge of the yarn storage region that corresponds to the distance of the yarn along the vertical axis of the yarn storage drum between an entry and an exit on the cylindrical yarn storage region.

By the arrangement, according to the invention, of the yarn takeoff guide element in relation to the essentially cylindrical yarn storage region, a yarn delivery device can be provided in which the supplied thread or yarn can be supplied for processing in different consumption amounts, without the yarn, at least one wrap of which is arranged on the yarn storage drum, being able to fall off from the yarn storage region. Furthermore, a compensation for the different yarn tensions can be ensured by this arrangement.

Furthermore, the invention has the advantage that, for example when the knitting machine is switched off because of a breakdown, in which the yarn storage drum, which is connected to be driven from the main drive wheel, is likewise immediately stopped, and the at least one yarn wrap below the lower drum edge of the essentially cylindrical yarn storage region can be prevented from falling off. On subsequent starting of the machine, the yarn can be wound up on the yarn storage drum and the yarn tension built up, according to the capstan principle. Thus no additional handles are required in order to place in readiness such yarn delivery devices, of which up to about 200 can be arranged on a textile machine.

Furthermore it can be made possible, by the embodiment according to the invention, to produce patterned knitted fabrics for which the yarn consumption can be smaller, as compared with a conventional stitch formation. Thus, for example, a loop or a float can be formed in which the yarn consumption is only 60 or 20%, measured against a stitch with 100%, without interruptions arising due to the at least one wrap falling off.

BRIEF DESCRIPTION OF THE DRAWING

Preferred embodiments of the invention will now be described, taken together with the drawing, in which:

FIG. 1 shows a schematized side view of the yarn delivery device according to the invention.

DESCRIPTION OF PREFERRED EMBODIMENTS

In FIG. 1, limited to the portions which are important for the invention, is shown a yarn delivery device 11 which is releasably fastened to a machine ring 12 of a textile machine. The yarn delivery device 11 has a yarn storage drum 13, which is drivingly connected by means of a drive gearwheel 16 arranged at one end of a shaft, and via a toothed belt 18, to a main drive wheel 17. The diameter of the main drive wheel is continuously adjustable, so that the rotational speed of the yarn storage drum 13 can be accommodated to the kind of yarn or thread to be processed.

A yarn 21 is drawn from a bobbin (not shown in the drawing) and runs through a yarn guide eyelet 22, and is then passed through a knot testing element (not shown in the drawing) in order to prevent knots passing through and being processed. The yarn 21 is then fed to a yarn braking device 23 and, after being braked, is fed via a yarn feed guide element 24 to the yarn storage drum 13. The yarn runs tangentially onto a yarn takeup region 26 of essentially slightly frustroconical form, as shown by the point 27. The yarn 21 is then drawn off tangentially, preferably after a complete wrap around the yarn storage drum 13, by a yarn takeoff guide element 28. The yarn which is drawn off is fed via a tension monitoring device 31 to a needle 32 for weft knitting. It can likewise be provided that several wraps are provided in the yarn takeup region 26 and/or in the yarn storage region 29.

The yarn 21 which runs onto the yarn storage drum passes through the yarn takeup region 26 and has a forwarding action in this. The rotation of the yarn storage drum 13 has the result that the yarn 21 lies against this free from slip and is drawn from the bobbin by friction, corresponding to the consumption. This action occurs between the points 27 and 33. The point 33 represents a transition from the yarn takeup region 26 to an essentially cylindrical, adjoining yarn storage region 29. At the point 33, the yarn enters the essentially cylindrical yarn storage region 29, and is drawn off tangentially at the point 34 from the essentially cylindrical yarn storage region 29. The partial wrapping of the yarn storage region 29 has a storing action, in contrast to the yarn takeup region 26. The gradient before and after the point 33, shown in FIG. 1, is shown as a straight line in an idealized manner, it being understood that the gradient in the yarn storage region 29 is smaller than in the yarn takeup region 26.

The yarn takeoff guide element 28 is arranged at a spacing, which corresponds at least to the segment between the points 33 and 34, from the lower edge 36 of the essentially cylindrical yarn storage region 29. It can likewise also be provided that the distance between the lower edge 36 and the yarn takeoff guide element 28 corresponds to the wrapping of the yarn 21 between the points 33 and 34. It is not absolutely required here that there is only a half turn here. A multiple wrap can also be provided.

The yarn takeoff guide element 28 is furthermore advantageously arranged close to the drum jacket 37 of the yarn storage region 29, so that when the yarn tension slackens, the sagging of the yarn 21 between the point 34 and the yarn takeoff guide element 28 can be kept small. Furthermore, it can thereby be achieved that the danger of the yarn 21 falling off the yarn storage region 29 when the tension slackens can be prevented. This advantage can also be attained by making the essentially cylindrical yarn storage region 29 large, seen in the axial direction, in contrast to the yarn takeup region 26. This can result, for example, from a one and a half times length along the one common long axis 39. Furthermore, it can be provided that the yarn storage region 29 is made still longer. In the embodiment according to the invention, it is advantageously provided that this is constructed as a hollow body, in order to be able to overcome small inertial moments when driving via the main drive wheel 17.

The yarn tension monitoring device 31 has the yarn takeoff guide element 28 and a yarn guide clement 41, between which the yarn 21 is guided in a straight line 42. A feeler element 43 engages the yarn 21 between the yarn takeoff guide element 28 and the yarn guide element 41, in the region 42 where the yarn is guided in a straight line, and is constructed as a force accumulator. The feeler element 43 is mounted to pivot about an axis of rotation 44, in order to deflect the yarn 21 when the tension falls, thereby compensating for the slackening of the yarn tension. For this purpose, the feeler element 43 has a lever-arm 52 with a bent end 46 which abuts against the yarn 21. An equalizing mass 48 is provided at an opposite end 47 of a lever arm 53, and deflects the feeler element in the direction of the arrow 49 when the yarn tension decreases, keeping the yarn 21 tensioned. It can likewise be provided, in contrast to the embodiment example, that the yarn 21 is deflected downwards; the feeler element 43, or respectively the force storage element, can be correspondingly constructed.

Alternatively, it can likewise be provided that a spring clement or the like can be provided instead of a compensating mass 48. The compensating mass 48 is arranged displaceably along the lever arm 53, so that the yarn tension monitor device 31 can be matched to the thread or yarn to be processed as regards the required yarn tension.

As soon as the deflection of the feeler element 43 exceeds a certain amount, a limit switch (not shown) can be actuatable which stops the textile machine and indicates a fault. This can take place, for example, by means of an acoustic or an optical signal. The limit switch is likewise actuated when a yarn break is present. The feeler element 43 is likewise deflected in the direction of the arrow 49 and actuates the limit switch.

Due to the high gear ratio between the main drive wheel 17, which is in synchronism with the textile machine, and the drive gearwheel 16 of the yarn storage drum 13, the latter is given a peripheral speed which is higher than the supply speed of the yarn 21 to the needle 32. The friction of the yarn 21 on the yarn storage drum 13 can be regulated by means of the continuously adjustable yarn brake device 23, and can be matched to the yarn consumption, and also to the yarn tension, corresponding to the knitting conditions. The wrap of the yarn 21 undergoes a forwarding action in, the yarn takeup region 26, due to the shallow frustroconical construction, since the friction increases with increasing yarn tension according to the capstan principle, and the yarn 21 tends to move towards the larger diameter of the yarn takeup region 26. When the yarn tension slackens, on the contrary, the friction diminishes, as does the amount forwarded, so that the amount of yarn is matched to the consumption requirement as soon as the yarn 21 leaves the yarn takeup region 26 and passes over to the yarn storage region 29. Thus no excessive delivery of yarn is to be expected in this region. The yarn storage region 29, which also has the function of an equalizing cylinder, at its rotational speed which is equally high as that of the yarn takeup region 26, has just the function of slightly reducing the stresses arising on the yarn takeup region 26. This is possible because the yarn storage region 29, at its high rotational speed, presents a long, uniform friction surface to the yarn 21.

For the processing of cotton, wool, blended yarns and synthetic yarns, the main drive wheel 17 and the yarn brake device 23 can be adjusted so that the yarn storage drum 13 forwards irregular amounts of yarn for patterned knitted fabrics also, and bridges over interruptions of yarn feeds, The surface of the yarn storage drum 13 is advantageously polished. It can likewise be provided that this is chromium plated or anodized, or surface finished in some other way.

The separate adjustability of the main drive wheel 17 and the yarn brake device 23 makes matching possible to the most varied kinds of threads and thus a universal use to attain a low yarn tension during weft knitting.

In addition to the arrangement of the yarn takeoff guide element 28 close to the drum jacket 37 of the yarn storage region 29 and the spacing to the lower edge 36 of the essentially cylindrical yarn storage region 29, the yarn tension monitoring device 31 can contribute substantially to preventing the wrap 38 from falling down from the yarn storage region 29 when the yarn slackens. At this instant, the feeler element 43 responds and first provides an equalization by the deflection of the yarn 21 guided between the yarn takeoff guide element 28 and the yarn guide element 41. With a further slackening, the feeler element 43 is deflected such that it actuates the limit switch and switches off the textile machine. Running on of the yarn is avoided by the simultaneous stopping of the yarn storage drum 13, so that an over-delivery of yarn does not occur. It can thus be ensured, by the action of the yarn brake device 23 and by the stopping, with the textile machine, of the yarn storage drum 13, that the at least one wrap 38 does not fall down from the yarn storage region 29. At the same time, in a such advantageous embodiment, a bead-free lower edge 36 of the yarn storage region 29 can be provided, such as is known from the state of the art to often give rise to a yarn break when several wraps 38 run on.

Moreover it can alternatively be provided that several wraps 38 are provided on the yarn storage drum 13. Moreover the yarn storage region can be made cylindrical or slightly conical, wherein preferably a conicity of less than 5° can be provided.

We claim:

1. Yarn delivery device for textile machines with a yarn storage drum (13) which is mounted rotatably and driven about an at least nearly vertical axis (39), and which has in its upper portion a frustroconical yarn takeup region (26) adjoined by an essentially cylindrical yarn storage region (29) with a bead-free lower edge (36), wherein a yarn (21) is guided tangentially by a yarn feed guide element (24) onto the yarn takeup region (26) of the yarn storage drum (13) and is tangentially taken off from the yarn storage region (29) by a yarn takeoff guide element (28) characterized in that the yarn takeoff guide element (28) is arranged with respect to the yarn storage region (29) such that the yarn (21) is taken off at least at a spacing from the lower edge (36) of the yarn storage region (29) corresponding to a distance which the yarn (21) has along the vertical axis (39) between an entry (33) and an exit (34) on the essentially cylindrical yarn storage region (29).

2. Yarn delivery device according to claim 1, characterized in that the yarn takeoff guide element (28) is arranged with respect to the yarn storage region (29) such that the yarn (21) is taken off at least at a spacing from the lower edge (36) of the yarn storage region (29) corresponding to at least one wrap (38) of the yarn (21) the yarn storage region (29).

3. Yarn delivery device according to claim 1, characterized in that the yarn takeoff guide element (28) is arranged with respect to the yarn storage region (29) such that the distance to the lower edge (36) includes at least half the length of the yarn storage region (29).

4. Yarn delivery device according to claim 1, characterized in that the yarn takeoff guide element (28) is arranged for a tangential yarn takeoff near to a drum jacket (37) of the yarn storage region (29).

5. Yarn delivery device according to claim 4, characterized in that the yarn takeoff guide element (28) is arranged at least at a spacing from the drum jacket (37) of the yarn storage region (29) which is smaller than half the diameter of the yarn storage region (29).

6. Yarn delivery device according to claim 1, characterized in that the yarn storage region (29) is made long in relation to the yarn takeup region (26).

7. Yarn delivery device according to claim 6, characterized in that the yarn storage region (29) has at least 1.2 times the length of the yarn takeup region (26).

8. Yarn device according to claim 1, characterized in that the yarn storage region (29) is from 1.2 to 1.8 times the length of the yarn takeup region (26).

9. Yarn delivery device according to claim 1, characterized in that the yarn storage region (29) is made cylindrical.

10. Yarn delivery device according to claim 1, characterized in that the yarn storage region (29) is of essentially cylindrical form and has a conicity of less than 10°.

11. Yarn delivery device according to claim 1, characterized in that the yarn storage drum (13) has a polished surface.

12. Yarn delivery device according to claim 1, characterized in that the yarn storage drum (13) has a chromium plated surface.

13. Yarn delivery device according to claim 1, characterized in that the yarn storage drum (13) is formed as a hollow body.

14. Yarn delivery device according to claim 1, characterized in that the positioning of the yarn feed guide element (24) is provided at the height of the yarn takeup region (26), and the yarn (21) is fed to the yarn takeup region (26) essentially horizontally.

15. Yarn delivery device according to claim 1, characterized in that a wrap (38) present on the yarn storage region (29) includes, from an entry (33) to, as far as an exit (34) from, the yarn storage region (29), at least half of the periphery of the yarn storage region (29).

16. Yarn delivery device according to claim 1, characterized in that a yarn tension monitoring device (31) is provided after the yarn takeoff guide element (28) in the yarn transport direction.

17. Yarn delivery device according to claim 16, characterized in that the yarn tension monitoring device (31) has the yarn takeoff guide element (28), a further yarn guide element (41), and a feeler element (43) which engages a straight run (42) of the yarn (21) between the yarn takeoff guide element (28) and the yarn guide element (41).

18. Yarn delivery device according to claim 17, characterized in that the feeler element (43) is deflected about a pivot axis (44), and the yarn (21) can be deflected, under tension, from a straight run (42) between the yarn takeoff guide element (28) and the yarn guide element (41).

19. Yarn delivery device according to claim 17, characterized in that the feeler element (43) has a lever arm (52), with a bent end (46), which engages the yarn (21), and an equalizing mass (48) at an opposite end (47) of a second lever arm (53).

20. Yarn delivery device according to claim 19, characterized in that the equalizing mass (48) is displaceably arranged on the second lever arm (53).

21. Yarn delivery device according to claim 1, characterized in that the feeler element (43) is formed as a force accumulator, and the yarn is deflected under tension.

22. Yarn delivery device according to claim 1, characterized in that the feeler element (43) has a spring element as the force accumulator element.

* * * * *